US006715220B1

(12) United States Patent
Isenberg

(10) Patent No.: US 6,715,220 B1
(45) Date of Patent: Apr. 6, 2004

(54) FOOTWEAR WITH STORAGE

(75) Inventor: Robert Isenberg, Lexington, MA (US)

(73) Assignee: Right Stuff, Inc., Burlington, MA (US)

( * ) Notice: Subject to any disclaimer, the term of this patent is extended or adjusted under 35 U.S.C. 154(b) by 61 days.

(21) Appl. No.: 10/082,411

(22) Filed: Feb. 25, 2002

(51) Int. Cl.[7] ..... A43B 23/00
(52) U.S. Cl. ..... 36/136
(58) Field of Search ..... 36/132, 136

(56) References Cited

U.S. PATENT DOCUMENTS

| | | | | | |
|---|---|---|---|---|---|
| 348,233 | A | | 8/1886 | Phalan | |
| 654,388 | A | * | 7/1900 | Diemer | 36/136 |
| 1,100,758 | A | | 6/1914 | McAuslin | |
| 1,289,341 | A | | 12/1918 | Wirsching | |
| D106,649 | S | | 4/1937 | Casey | |
| D156,169 | S | | 11/1949 | Rishell | |
| 2,712,700 | A | | 7/1955 | Solomon | |
| 2,986,743 | A | * | 6/1961 | Eilen | 2/247 |
| 3,114,982 | A | * | 12/1963 | McGowan | 36/132 |
| 3,611,444 | A | * | 10/1971 | Rector | 2/227 |
| 4,218,781 | A | * | 8/1980 | Lieberman | 2/247 |
| 4,280,287 | A | | 7/1981 | Gulbransen | |
| 4,296,559 | A | | 10/1981 | Gamm | |
| 4,384,414 | A | | 5/1983 | Gamm | |
| 4,485,496 | A | * | 12/1984 | Shanks, Jr. | 36/136 |
| D277,615 | S | * | 2/1985 | Gamm | D2/912 |
| D277,616 | S | | 2/1985 | Gamm | |
| 4,507,882 | A | | 4/1985 | Harrell | |
| D280,777 | S | | 10/1985 | Gamm | |
| 5,094,016 | A | | 3/1992 | DiVito | |
| 5,136,726 | A | * | 8/1992 | Kellin et al. | 2/244 |
| D343,043 | S | | 1/1994 | Campbell | |
| 5,311,679 | A | | 5/1994 | Birch, Sr. | |
| D356,664 | S | | 3/1995 | Cesaretti | |
| D358,932 | S | | 6/1995 | Barton et al. | |
| D378,010 | S | | 2/1997 | Isenberg | |
| D403,850 | S | | 1/1999 | Herndon | |
| D404,546 | S | | 1/1999 | Isenberg | |
| 5,970,633 | A | * | 10/1999 | Jones et al. | 36/136 |
| 5,988,468 | A | * | 11/1999 | Murdoch et al. | 224/237 |
| D442,356 | S | | 5/2001 | Aschenbrenner | |
| 6,449,881 | B1 | * | 9/2002 | Assaf et al. | 36/136 |
| 6,457,266 | B1 | * | 10/2002 | Hsiao | 36/136 |

* cited by examiner

*Primary Examiner*—Ted Kavanaugh

(57) ABSTRACT

Foot wear with storage pack with features that are attractive to a child and encourage cooperation and use.

7 Claims, 3 Drawing Sheets

FOOTWEAR WITH STORAGE

BACKGROUND OF THE INVENTION

The present invention relates to footwear, and, more particularly, to children's shoes, boots and the like with storage.

Parents wish to have their children appropriately dressed for the season. Inclement weather, heavy rains, snow and cold are good reasons for children to wear protective footwear.

But getting children to cooperate and wear such things is not an easy matter. Therefore any method or feature that encourages child cooperation in the wearing of proper footwear is welcome. It is even desirable that children look forward to wearing their footwear, to using it well, and to maintaining continued ownership.

Techniques for encouraging cooperation of children have filled many volumes of learned discourse. There is no magic formula for successfully engaging of a child's attention and successfully achieving a desired behavior. Certainly bribery (with candy and ice cream) can be attempted, but this only has marginal impact and if done too often can have ill effects. Flattery often works with the parents, but there is scant evidence that a child will behave as desired on a consistent basis simply based on flattery alone.

It is therefore an object of the present invention to provide articles of footwear whose design and function can encourage cooperation of a child for donning and conserving of same.

It is a further object of the present invention to provide footwear with storage features that will be appreciated by a youthful user.

It is another object of the present invention to provide a portable storage device that a child will be enthused to use.

SUMMARY OF THE INVENTION

These and other objects are well met by the presently disclosed footwear having an attractive and familiar storage pack affixed thereto, such as a backpack. The backpack is a popular functional article for the average school-age child, and its attachment to an article of footwear has distinct advantages. Alternatively, footwear having a gentler or more feminine packaging, such as a ditty bag, or a soft pouch, affixed to a boot, also serves the objects of the present invention. The present invention discloses footwear with added features. These features are intended to have an attractiveness or familiarity for a child and which also may serve a useful storage or other function.

Embodiments of the invention provide footwear with storage and other features. In one embodiment of the present invention, footwear is provided that has storage compartments and pockets, such as provided by a backpack specially attached thereto. Preferably the footwear is a pair of children's boots and a storage pack is attached to the upper portion of each boot. The upper portion has a front, side and rear extent above the sole and heel, and the storage pack can be attached to any of these extents. The storage pack is designed to be attractive to the child user, as well as providing a storage function.

Preferred features of storage packs according to the invention are attractiveness to a child (either by familiarity or some other special creative feature) and provision of useable storage ability, in a totality that engages the attention of the child, and being readily attachable in a practical manner to footwear. Reflective tape can be added to the storage pack to provide added safety when the footwear is worn at night.

The storage packs on boots are attractive and also enable safe storing of small items such as money or keys. Preferably a mesh is used on the storage pack that is sporty and current-looking and favors drying.

The system of attachment of the storage pack to the boot is either direct, such as by sewing or by a preferred flexible attachment member. Use of the latter can avoid tearing or opening up of leakage sites where the storage pack is attached to the boot.

In another aspect of the invention, footwear and storage apparatus is provided with a foot covering having an upper portion, a heel and a sole, a storage pack, the storage pack having at least one storage compartment, and the at least one compartment having an ingress opening and a closure, with the closure selectively limiting access to the compartment via the ingress opening, and the storage pack for mounting on the foot covering. In one embodiment, there is a pocket defining a second storage compartment, wherein the storage pack is an attachable backpack store, ditty bag store, or pouch store, and this "store" is proportioned and configured to be attached to the upper portion of the footwear. In one practice of the invention, the storage pack is a storage compartment attached to the upper portion, and the storage compartment is defined as attractive to a child based on having a familiar configuration from the class of goods generally referred to as a backpack, ditty-bag or pouch with multiple stores.

In a further embodiment, the portion has a front extent, side extent and rear extent and the storage pack is attached to one of these extents, with the foot covering comprising one boot of a pair of boots. The storage pack may further have an association feature, wherein a school child can associate the association feature with an article of common usage from the class of goods including a backpack, a ditty-bag or a pouch with multiple stores. Thus a miniature backpack is attractive to a child and as attached to a boot draws the child's attention, for example. Preferably the closure defines an adjustable closure mechanism, such as a draw string, elastic tape, string, zipper, hook and eye, button, pin, clip, or the like.

Various comfortable and interesting specialty materials may be used in practice of the invention to create an attractive mode. The attractive mode may include mesh, felt, fuzzy and furry materials. It will further be appreciated that the exposed surfaces of the foot covering may be provided with a variety of colors and patterns, including logos, insignia, and names.

BRIEF DESCRIPTION OF THE DRAWINGS

These and other features and advantages of the present invention will be more fully understood by reference to the following detailed description in conjunction with the attached drawing in which like reference numerals refer to like elements and in which.

DETAILED DESCRIPTION OF THE PREFERRED EMBODIMENT

Figure 1:
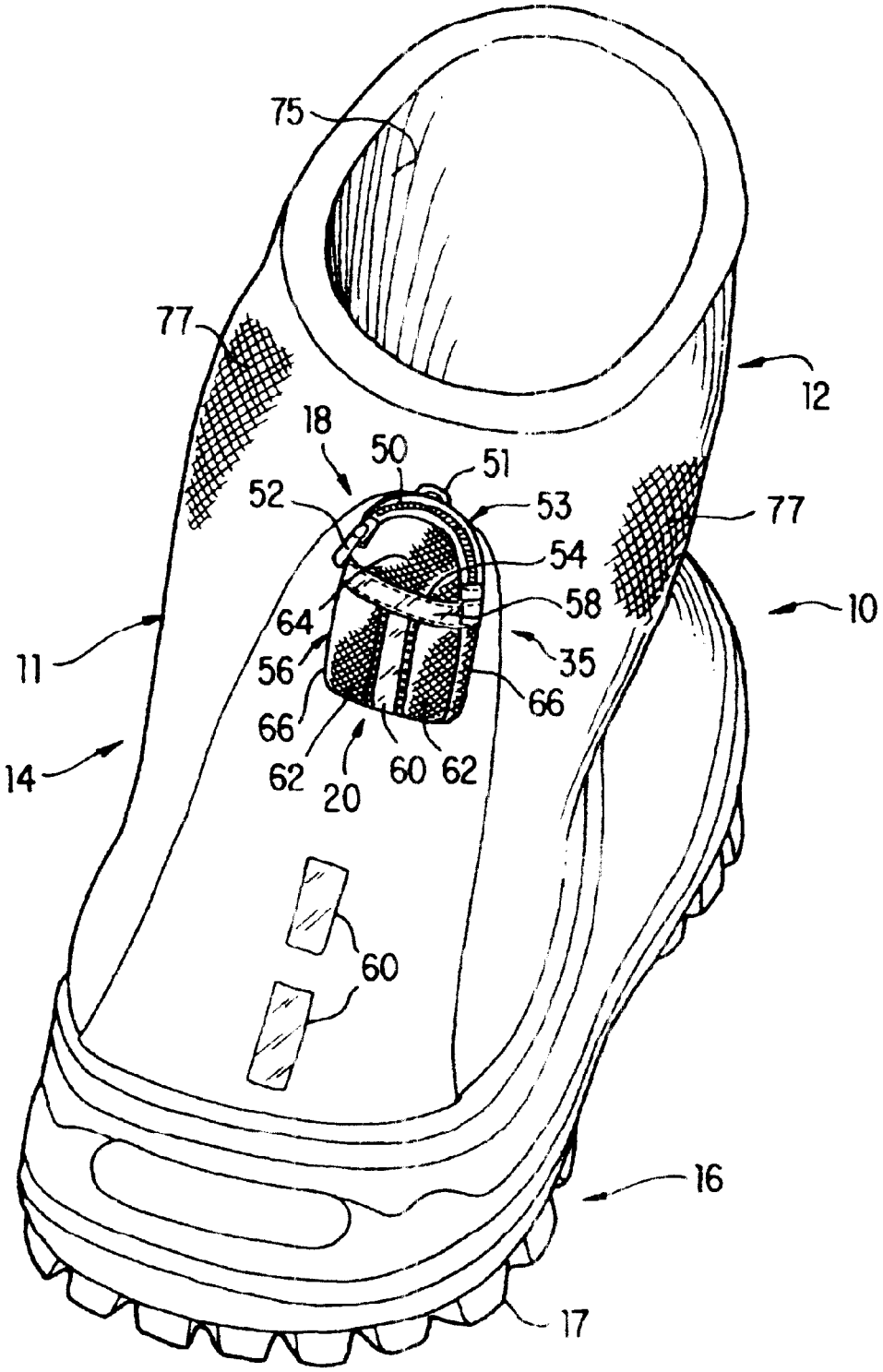
FIG. 1 is a perspective view of a backpack embodiment of the present invention.
Figure 2:
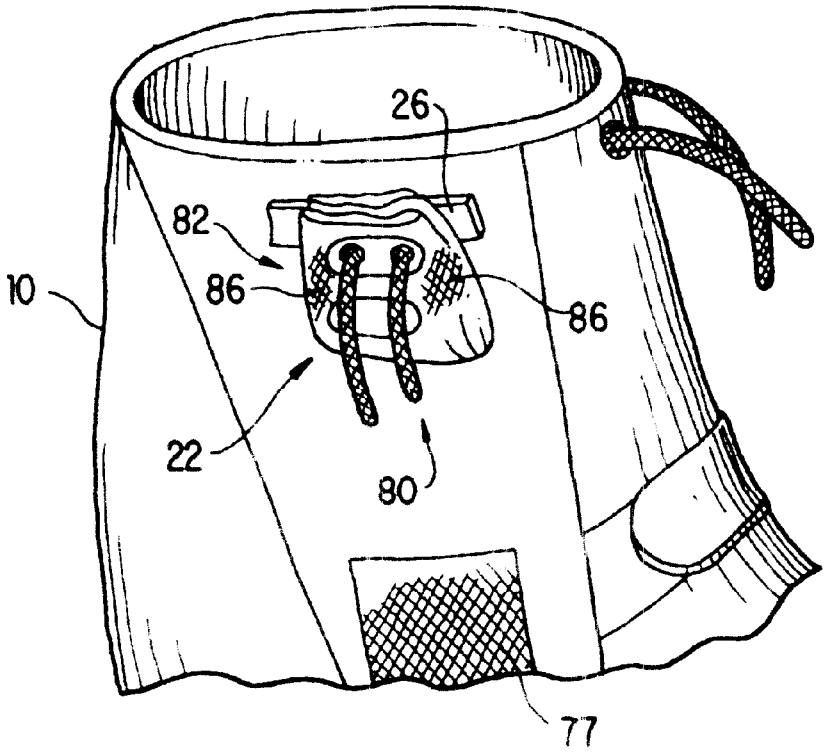
FIG. 2 is a partial side view (left or right boot) of a ditty bag embodiment of the present invention.

Referring to the FIG. 1, in an illustrative practice of the invention, footwear 10, e.g., a winter boot, is defined having an exposed upper portion 11 (defined by higher 12 and lower 14 riser portions) and the balance of the boot being heel and sole 16, 17. Affixed to boot 10 is an attractive storage pack (i.e., a container) 18. In this embodiment, the storage pack is a backpack 20. In alternative embodiments, attractive storage pack 18 is a ditty bag 22, FIG. 2, or a pouch 24, FIG. 3, or the like. Storage pack 18 may be attached to the rear (FIG. 1) side (FIG. 2), or front (FIG. 3) of the boot. Each storage pack 18 preferably has features that are recognizable and attractive to the child user; these features may relate to storage, games, materials (as in reflective), and other attractive features.

Selection and use of a backpack, ditty bag, or pouch design is advantageous and with special purpose. Many young children use such storage packs as schoolbags. They are thus familiar with and often enjoy the design of such packs. Familiar look and extra storage compartments engage the attention of the child. By connection of these items to the boots, the result is more likely cooperation of the child to wear boots when requested by a parent. This is augmented with the further benefit of the child actually being able to use the pack as a reliable and safe storage compartment (for a key or coins or the like). With this in mind, the backpack 20, ditty bag 22 or pouch 24 are selected as meeting the demands of being familiar and child-friendly, storage capable, and attachable in a practical manner. They are an improvement over the dull and conventional pockets and the like that have in the past been attached to or associated with footwear in the past.

FIG. 1 will be appreciated to convey that storage pack 18 (whether backpack 20, ditty bag 22, or pouch 24) is affixed to boot 10. This attachment is either direct or via an intermediary. Direct attachment may be by sewing, gluing, welding or the like. Direct attachment may create potential leakage points where the storage pack is attached to the boot on upper riser portion 12. Extra sealing may then be required to assure for longevity.

In practice of a preferred embodiment of the invention, opening of potential leakage points is avoided wherein storage pack 18 is attached to the boot via an intermediary joining mechanism 26. Joining mechanism 26 provides a flexibility that avoids damage to the storage, pack and/or boot during boot wear and use and also eases attachment of storage pack 18 to boot 10 during manufacture.

Figure 4:
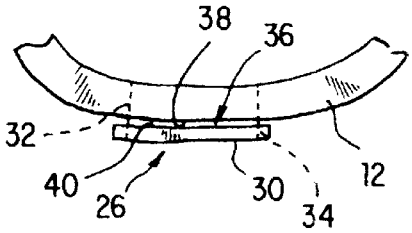
FIG. 4 and FIG. 5 show a preferred attachment mechanism of the invention.

In the illustrative embodiment of FIG. 4, joining mechanism 26 includes a strip 30 mounted to boot upper 12 via attachments 32, 34, such as by weld or glue or seams sewn through strip 30 and boot upper 12. The boot upper 12 is flexible and the strip 30 is preferably flexible, such that the joined combination forming joining mechanism 26 is flexible, and this therefore provides flexible mounting of storage pack 18. The entire joined assembly 35 is simply formed and functions in a flexible manner. It will be further noted that attachment of strip 30 is simplified, in that it is a simple flat piece as opposed that is easily accessed as opposed to sewing to the inside of the storage pack during direct attachment.

Figure 5:
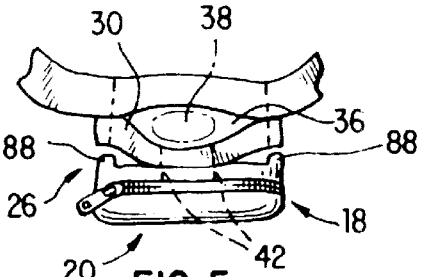

As shown in FIG. 5, in one embodiment, boot upper 12 and strip 30 are flexible and are mated such that a gap 36 is flexibly definable between the outer surface 38 of upper 12 and the inner surface 40 of strip 30. During manufacture, the flexible structure at gap 36 admits entry of an attachment head 38 for the purpose of effecting attachment of storage pack 18 to boot 10 via the previously attached strip 30 of the flexible joining mechanism 26.

Attachment head 38 can be a gun for welding or gluing or sewing, or the like, such that storage pack 18 is mated to strip 30 at one or several seams or joints 42, 42 on strip 30, and then attachment head 38 is removed. Entry of an attachment device 38 deforms the local structure temporarily at gap 36 as shown in FIG. 5, but the assembly is resilient and returns flat as shown in FIG. 4 upon removal of head 38.

Figure 3:
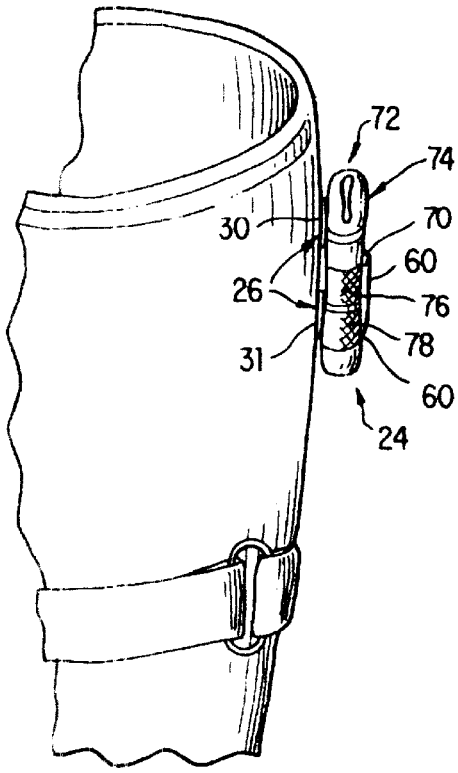
FIG. 3 is a partial front view (left or right boot) of a pouch embodiment of the present invention.

Joining mechanism 26 may optionally include a second strip 31, shown in FIG. 3. Strips 30, 31, enable flexible attachment of both the upper and lower sections of storage pack 18 to boot 10. Strip 31 is like strip 30 and functions in a similar manner.

While attachment of storage pack 18 to boot 10 is preferred to be permanent, in yet another embodiment of the invention the attachment of storage pack 18 at seams or joints 42, 42 may be quasi-permanent, such as with snaps, buttons or eye-hook type fasteners.

Backpack 20 preferably has a zipper 50 with pull 52 defined along the top ridge of main storage compartment 53. The front of the storage pack has a pocket 54 defined by material layer 56 formed over the lower face of the backpack. This material layer 56 is preferably defined by a first reflective strip 58 and a second reflective strip 60 that provide extra safety for the child walking in the dark. Reflective strips 60 may also be added directly to the boot, as shown in FIG. 1. It will be appreciated that lights, particularly car lights, will illuminate and reflect on these strips, adding important extra visibility for the user. Pocket 54 adds extra enjoyment for the child, while reflective strips 58, 60 provide an extra measure of safety.

Material layer 56 is preferably a panel of mesh material 62. The main facing 64 of backpack 20 may also be mesh, as also may be the side panels 66, 66. Meshing is a popular material in sports shirts and pants, such as for running, and adds an up-to-date and sporting look to the storage pack. This feature of the invention therefore further adds to the attractiveness of boot 10 to the child, making it easier again for the parent to urge the child to wear the boots as needed in a storm. Functionally, the mesh also allows the storage pack to breath, which will favorably provide for quick drying after use in wet weather.

Pouch 24 may also feature a pocket 70, and a closure 72 at the mouth of main storage compartment 74, and may also feature mesh material 76, 78. Ditty bag 22 has pull closure 80 at the mouth of main storage compartment 82, and may also feature mesh material 86. The closure defines an adjustable mechanism, and may include a draw string, elastic tape, string, zipper, hook and eye, button, pin, clip, or the like.

In a further embodiment of backpack 20, vertical details 88 are formed along the rear of the backpack, as shown in FIG. 5. These details appear as if they are the familiar rear straps of a conventional backpack, and thus lend an extra familiarity to the storage pack for the child user. These details 44 may be formed as extra strips of material or may be gathered or raised material, with the purpose of providing such familiar appearance. The backpack, ditty bag and pouch may have straps, as desired. A handle 51 may be supplied along the top of the storage pack, to create further realistic appearance.

The pack may be made with a variety of materials, which may include mesh, felt, fuzzy and furry materials. The boot may also include the same or combinations of such materials, such as might add comfort at the boot interior, or color and patterns, including logos, insignia, and names. For example, boot 10 may include felt boot interior 75 and decorative or functional mesh panels 77. Thus the boots of the invention can be functional, comfortable and attractive, with an extra storage feature.

It will now be appreciated that embodiments of the present invention provide a pair of boots (or shoes or sneakers) configured to serve multiple functions. A first function is as a foot covering, per se. For a second function, the footwear is provided with a special pocket, preferably formed as a miniature backpack, ditty bag or pouch, with compartments to meet storage needs. The combination of pack and footwear forms an attractive product that encourages its use and forms an attachment with the child. This increases the possibly that the child will willingly wear the footwear when asked and will even wear the footwear home from school without loss or misplacement.

The present invention provides articles of footwear that catch a child's attention and its availability may help secure good behavior of a child. At the very least, the boot design, and perhaps the fact of storage of money, a key or the like, in the storage pack, can lead to the child forming an attachment to the boot that will work against the boots ending up in the lost and found.

The embodiments and examples disclosed herein are shown by way of illustration and not by way of limitation. The attached storage pack may be best understood as a miniature container and is preferably scaled according to the boot dimensions to which it is attached. The concept of "mating" has been used in its illustrative sense and can be accomplished by stitching, gluing, crimping and other forms of attachment within the scope of the invention. It will be further appreciated that various modifications of the specific embodiments set forth above are also within the spirit and scope of the invention. While a preferred embodiment forms a favorable footwear system showing a pair of boots as footwear, this may also be achieved as shoes, sneakers and the like, and still will be within the scope of the invention.

What is claimed is:

1. Footwear with attractive storage compartment, said footwear comprising:

a footwear having an upper portion, an ankle portion and a lower portion, said lower portion extending downward from said ankle portion and defining a foot space volume for accommodating a wearer's foot, and said footwear having an upper portion extending above said ankle portion, further including a recognizable backpack-like storage pack, said storage pack being affixed to said upper portion above said ankle portion, said storage pack including a front part, left side part, right side part, bottom part, and top part, and further including a rear panel and a front panel, said parts permanently mated to said panels to define said storage pack with an internal storage compartment, said side parts attached to said bottom part and rising upwardly for meeting at said top part, said top part defining a closure device for permitting access to said internal storage compartment, a material layer defined at least in an area of said front panel, said material layer appearing to define a storage space of low volume between said material layer and said front panel, the volume of said storage compartment being substantially greater than the apparent volume of said front storage space and substantially less than said foot space volume, wherein said storage pack is a miniaturized backpack and is substantially reduced in size compared to said boot.

2. Footwear of claim 1 wherein said closure device is flapless.

3. Footwear of claim 2 wherein said closure device is a zipper.

4. Footwear of claim 3 wherein said footwear includes a boot and wherein said storage pack has the attractive and recognizable appearance of a miniature backpack, said appearance arising from combination of defining said volume of said storage compartment 1) as substantially greater than the volume of said front storage space, 2) as substantially less than said foot space volume, and 3) wherein said footwear is too large to be stored in said storage compartment.

5. Footwear of claim 1 wherein said footwear includes at least one boot and said storage pack is mated to the rear of said boot at said upper portion.

6. Footwear of claim 5 wherein said storage pack is mated to and compactly abuts the rear of said boot at said upper portion.

7. Footwear of claim 6 wherein said storage pack has a backpack configuration, in miniature, which is designed to be attractive to a child, and provides a storage function.

* * * * *